US009039361B2

(12) United States Patent
Fukuda et al.

(10) Patent No.: US 9,039,361 B2
(45) Date of Patent: May 26, 2015

(54) CENTRIFUGAL FAN

(75) Inventors: Takako Fukuda, Nagano (JP); Masaki Ogushi, Nagano (JP); Seiya Fujimoto, Nagano (JP); Yuzuru Suzuki, Nagano (JP)

(73) Assignee: Minebea Co., Ltd., Nagano (JP)

( * ) Notice: Subject to any disclaimer, the term of this patent is extended or adjusted under 35 U.S.C. 154(b) by 621 days.

(21) Appl. No.: 13/294,571

(22) Filed: Nov. 11, 2011

(65) Prior Publication Data

US 2012/0134795 A1 May 31, 2012

(30) Foreign Application Priority Data

Nov. 26, 2010 (JP) ..... 2010-263053

(51) Int. Cl.
*F04D 29/44* (2006.01)
*F04D 25/06* (2006.01)
*F04D 29/42* (2006.01)

(52) U.S. Cl.
CPC ..... *F04D 25/0613* (2013.01); *F04D 29/4226* (2013.01); *F04D 29/441* (2013.01)

(58) Field of Classification Search
CPC ... F04D 17/16; F04D 25/0613; F04D 29/441; F04D 29/4206; F04D 29/4226
USPC ..... 415/203, 204, 206, 208.1–208.3, 211.1, 415/211.2, 224.5, 225, 226
See application file for complete search history.

(56) References Cited

U.S. PATENT DOCUMENTS

| | | | | |
|---|---|---|---|---|
| 2,201,867 | A | 5/1940 | McMahan | |
| 6,652,223 | B1 * | 11/2003 | Horng et al. | 415/53.1 |
| 6,664,673 | B2 * | 12/2003 | Askhatov et al. | 310/63 |
| 2009/0142179 | A1 * | 6/2009 | Hwang et al. | 415/98 |

FOREIGN PATENT DOCUMENTS

| | | | |
|---|---|---|---|
| GB | 1 512 294 | A | 6/1978 |
| JP | 63-289295 | A | 11/1988 |
| JP | 10-153196 | A | 6/1998 |
| JP | 2000-341902 | A | 12/2000 |
| TW | 505376 | U1 * | 10/2002 |
| WO | 00/74213 | A1 | 12/2000 |

OTHER PUBLICATIONS

"Basic Concepts in Environmental Sciences—Module 5: Flowcharts and Ventilation Systems—Fant Types", Nov. 14, 2004, United States Environmental Protection Agency, pp. 1-3, Internet Archive—Wayback Machine, <https://web.archive.org/web/20041114164453/http://www.epa.gov/eogapti1/module5/fans/types/types.htm>.*

* cited by examiner

*Primary Examiner* — Dwayne J White
*Assistant Examiner* — Alexander White
(74) *Attorney, Agent, or Firm* — Carrier Blackman & Associates, P.C.; Joseph P. Carrier; Anne G. Sabourin

(57) ABSTRACT

A centrifugal fan is provided. The centrifugal fan is configured such that an impeller having plural blades disposed between a disk-shaped main plate and an annular shroud along a circumferential direction is accommodated 5 in a casing, and that an air suctioned from a suction opening is discharged outward in a radial direction of the impeller by a centrifugal force due to a rotation of the impeller, and thereby discharging the air from the casing. The casing includes an upper plate, a lower plate, and plural supporting struts interposed between the upper plate and the lower plate, and 10 lateral sides of the casing have only the supporting struts to form a discharge opening.

8 Claims, 12 Drawing Sheets

PRIOR ART

PRIOR ART

PRIOR ART

CENTRIFUGAL FAN

BACKGROUND OF THE INVENTION

1. Field of the Invention

The present invention relates to a centrifugal fan, and more particularly, to a centrifugal fan which can reduce noise at air blowing.

2. Description of the Related Art

A centrifugal fan is configured by providing an impeller in a scroll casing. The impeller has a plurality of blades disposed around a rotation shaft of a motor, and the scroll casing has a suction opening and a discharge opening. Air suctioned from the suction opening flows from the center of the impeller into between the blades, and is discharged outward in the radial direction of the impeller by a fluid force due to a centrifugal action from the rotation of the impeller. The air discharged from the outer circumference of the impeller passes through the scroll casing to become high-pressure air, and is discharged from the discharge opening.

This centrifugal fan is widely used for cooling, ventilation, and air conditioning in home appliances, OA devices, and industrial equipment, an air blower for a vehicle, and the like. However, due to the configuration of the centrifugal fan, the air blowing performance and noise are significantly influenced by the blade shape of the impeller and the shape of the scroll casing.

Therefore, in order to reduce noise and improve air blowing performance, the optimization of the shape of the impeller and the configuration of the scroll casing has been attempted, and various proposals have been made. A centrifugal fan which optimizes a blade shape of an impeller to reduce noise has been proposed (see, for example, JP-A-S63-289295).

FIG. 11 is a plan view illustrating a centrifugal fan described in JP-A-S63-289295, and FIG. 12 is a perspective view illustrating an impeller of FIG. 11. The impeller 120 of the centrifugal fan includes a plurality of blades 123 installed between a main plate 121 and a sub plate 122 wherein the outer circumferential side of the blades 123 rotates with delay from the inner circumferential side of the blades 123 in the rotation direction of the impeller 120. A scroll casing 127 is attached to the impeller 120 to blow air.

The blown air is suctioned from the suction opening 140 of the impeller 120, discharged from the outer circumference due to the centrifugal action of the blades 123 of the impeller 120, guided to an air outlet 141 of the scroll casing 127 along the scroll casing 127 surrounding the outer circumference of the impeller 120, and discharged outside. In this blade configuration in which the outer circumferential side of the blades 123 rotates with delay from the inner circumferential side of the blades 123 in the rotation direction of the impeller 120, the blades are backward inclined blades and have a curved blade shape inclined backward in the rotation direction. The centrifugal fan having that blade shape is generally called a turbofan.

In the turbofan shown in FIG. 11, the plurality of blades 123 are interposed between the main plate 121 and the sub plate 122 having the same outside diameter, and the blades have tailing edges cut such that a blade arc 135 on the main plate side is shorter than a blade arc 134 on the sub plate side. Therefore, a time difference is generated between a time when each tailing edge 131 located on the main plate side crosses a tongue section 129 of the casing and a time when a corresponding tailing edge 132 located on the sub plate side crosses the tongue section 129 of the casing, such that pressure fluctuation occurring when the blades 123 cross the tongue section 129 of the casing is dispersed temporally, and sound generating energy is dispersed, so that generation of noise can be suppressed.

Recently, a noise reduction and a size reduction have been strongly demanded for centrifugal fans to be assembled in air blowers for home appliances, OA devices, and vehicles, and the like.

The turbofan described in JP-A-S63-289295 realizes suppression of noise when air is blown, by the shape of the blades 123. However, since it has a configuration in which air discharged from the outer circumference of the impeller flows along the inner wall surface of the scroll casing 127 and is discharged from the air outlet 141, disturbance of the air flow easily occurs in the vicinities of the inner wall surface and the air outlet 141 of the scroll casing 127, and the disturbance of the air flow causes noise.

Moreover, since the scroll casing 127 requires forming a flow path for guiding air to the air outlet 141 in the outer circumference of the impeller 120, the outside diameter of the scroll casing 127 needs a size of about two times the outside diameter of the impeller 120, and thus a reduction in size of the turbofan is difficult.

SUMMARY OF THE INVENTION

The present invention has been made in view of the above circumstances, and it is an aspect of the present invention to provide a small-5 sized centrifugal fan with low noise at air blowing by optimizing a casing shape.

The inventors of the present invention have analyzed a relation between a configuration of a casing and noise in a centrifugal fan. As a result, the inventors have found that it is possible to reduce noise of the centrifugal fan specifically by optimizing the casing configuration.

Specifically, according to an illustrative embodiment, there is provided a centrifugal fan configured such that an impeller having a plurality of blades along a circumferential direction and disposed between a disk-shaped main plate and an annular shroud is accommodated in a casing, and that an air suctioned from a suction opening is discharged outward in a radial direction of the impeller by a fluid force due to a centrifugal action from a rotation of the impeller, and thereby discharging the air from the casing. The casing includes an upper plate, a lower plate, and a plurality of supporting struts interposed between the upper plate and the lower plate, and lateral sides of the casing have only the supporting struts to form a discharge opening. The air discharged outward in the radial direction of the impeller is discharged from the discharge opening. Each of the plurality of supporting struts has a lateral face, and a blowing direction of air from the impeller matches the lateral face of the supporting strut in a vicinity of the supporting strut.

According to the above configuration, the air discharged outward in the radial direction of the impeller is not disturbed at the lateral sides of the casing, and thus it is possible to significantly suppress noise due to air disturbance when the air is blown. Further, the casing can be formed to have the substantially same dimension as the dimension of the outside diameter of the impeller. Therefore, it is possible to reduce size compared to the related-art centrifugal fan having the scroll casing.

In the above configuration, the plurality of supporting struts may have a cylindrical shape and allow connecting members for connecting the upper plate and the lower plate to pass through the supporting struts.

According to this configuration, the air discharged from the impeller can be discharged outward from the lateral sides of the casing with rarely receiving resistance. Therefore, it is possible to further reduce noise.

In the above configuration, alternatively, the plurality of supporting struts may have a blade shape and allow connecting members for connecting the upper plate and the lower plate to pass through the supporting struts.

According to this configuration, the air discharged from the impeller can be discharged outward from the lateral sides of the casing with rarely receiving resistance. Therefore, it is possible to increase the static pressure of air discharged from the impeller.

DETAILED DESCRIPTION

Figure 1:
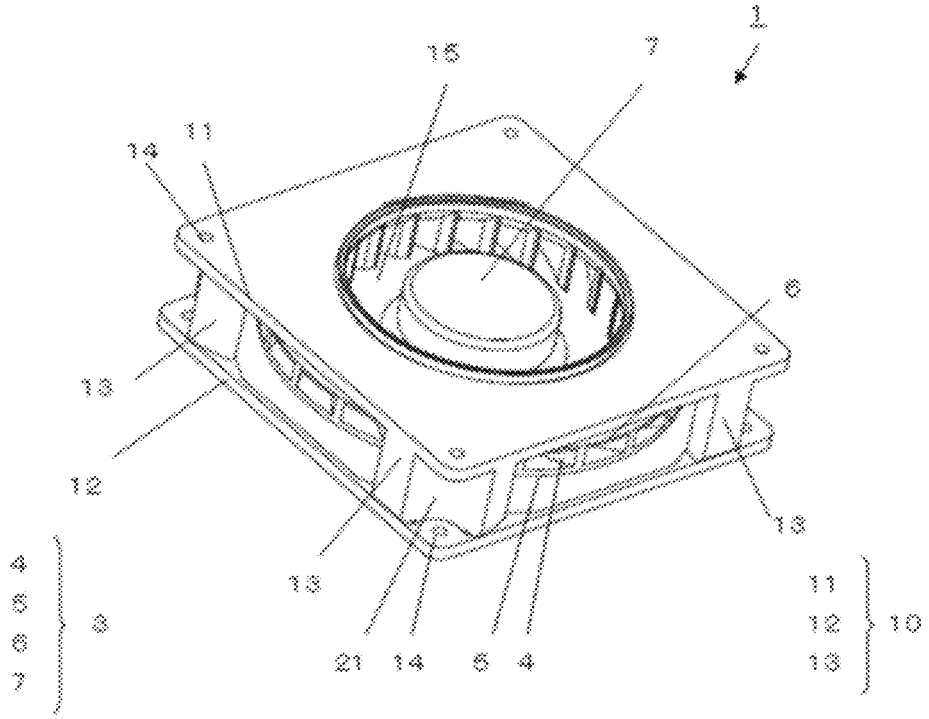
FIG. 1 is a perspective view illustrating a centrifugal fan according to an illustrative embodiment of the present invention.
Figure 2:
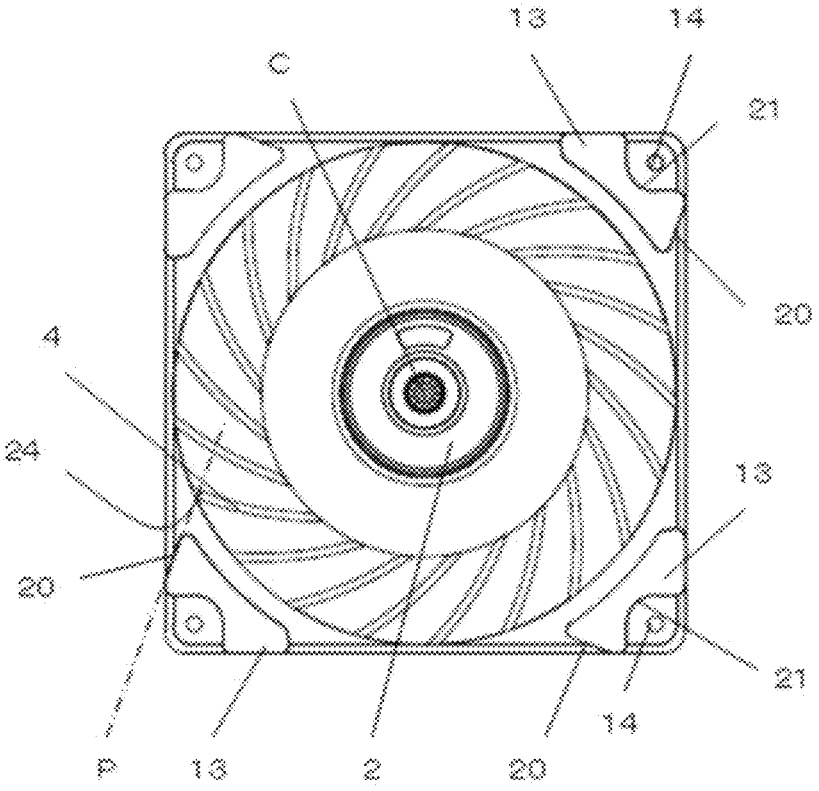
FIG. 2 is a plan view illustrating the centrifugal fan shown in FIG. 1, wherein a lower plate of a casing is removed.
Figure 3:
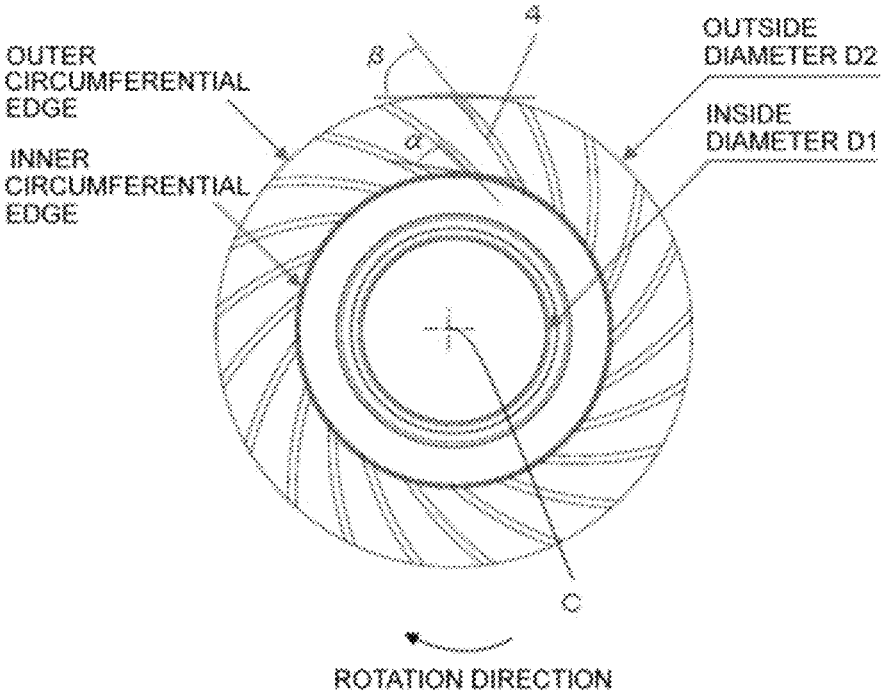
FIG. 3 is a view illustrating an impeller of the centrifugal fan of FIG. 1.

Hereinafter, illustrative embodiments of the present invention will be described with reference to the accompanying drawings. FIG. 1 is a perspective view illustrating a centrifugal fan according to an illustrative embodiment of the present invention, FIG. 2 is a bottom view illustrating the centrifugal fan shown in FIG. 1 wherein a lower plate of a casing is removed, and FIG. 3 is a plan view illustrating an impeller of the centrifugal fan of FIG. 1.

A centrifugal fan 1 includes an impeller 3 and a casing 10 accommodating the impeller 3. The impeller 3 includes a plurality of blades 4 and is rotated by a motor 2.

The impeller 3 is configured such that the plurality of blades 4 are disposed at an equal interval in a circumferential direction, that one ends of the blades 4 are supported by a main plate 5 and the other ends of the blades 4 are supported by an annular shroud 6. The plurality of blades 4 are interposed between the main plate 5 and the annular shroud 6. The main plate 5 has a disk-shape and includes a cup 20 shaped boss part 7 at the center thereof. The blades 4 have a curved shape with a predetermined curvature and all have a same shape. A rotor part of the motor 2 is coupled to the inside of the cup-shaped boss part 7, and the impeller 3 rotates according to the rotation of the rotor part.

The casing 10 has a square shape, and includes an upper plate 11 which is made of a synthetic resin and has a circular opening at the center thereof, a lower plate which is made of a synthetic resin. Supporting struts 13 are respectively provided in the vicinities of four corner sections of the upper plate 11 integrally with the upper plate 11 by molding. The upper plate 11 and the lower plate 12 are connected together with the supporting struts 13 interposed therebetween. The upper plate 11 and the 30 lower plate 12 are connected together by inserting a connecting member (such as a bolt or a rivet) into through-holes 14. Since the upper plate 11 and the lower plate 12 are connected to each other such that the four supporting struts 13 are interposed therebetween, the casing 10 has no lateral side wall. In other words, a lateral side of the casing 10 has only the supporting struts 13 to form openings. Further, the impeller 3 is accommodated in the casing 10. The lateral faces 20 of the supporting struts 13 are formed such that a line segment P passing through the center point (not shown) of the radius of curvature of an arc surface of each of the blades 4 and a leading edge 24 of the outer circumferential edge of the corresponding blade 4 substantially matches the lateral face 20 of a corresponding supporting strut 13. Therefore, in the vicinities of the supporting struts 13, a blowing direction of air discharged from the outer circumferential edge of the impeller 3 becomes parallel with the lateral face 20 of a corresponding supporting strut 13, and therefore, the air discharged from the outer circumferential edge of the impeller 3 is smoothly discharged to the outside of the casing 10 along the lateral faces 20, without being disturbed by the supporting struts 13.

The dimension of the outside diameter of the impeller 3 is set to be smaller than the dimension of one side of the casing 10. In a case where the dimension of the outside diameter of the impeller 3 is larger than the dimension of one side of the casing 10, since the rotating impeller 3 protrudes from the outer edge of the casing 10, it is feared that the impeller 3 will come into contact with another member or be damaged by the contact, which is not desirable. For this reason, it is desired to set the dimension of the outside diameter of the impeller 3 such that the outside diameter of the impeller 3 does not protrude from the outer edge of the casing 10.

The opening formed at the center of the upper surface of the upper plate 11 serves as a suction opening 15. When the motor 2 is driven, the impeller 3 is rotated according to the rotation of the rotor part, so that air suctioned from the suction opening 15 is discharged outward in the radial direction of the impeller 3 by a fluid force due to a centrifugal action from the rotation of the impeller 3, and is discharged outward from the lateral openings of the casing 10.

FIG. 3 is a plan view illustrating the impeller 3 shown in FIG. 1. The outside diameter D2 of the impeller 3 is 120 mm, the inside diameter D1 of the impeller 3 is 50 mm, the blades 4 are disposed at an equal pitch, and the number of blades 4 is set at 21. An exit angle $\beta$ of each blade 4 is set to 45 degree if an angle formed by a tangential line of a circle having a radius equal to a line segment connecting the center C of the rotation shaft of the fan and the outer circumferential edge of each of the blades 4 and the corresponding blade 4 is defined as the exit angle. An entrance angle $\alpha$ is set to 40 degree if an angle formed by a tangential line of a circle having a radius equal to the line segment connecting the center C of the rotation shaft of the fan and the inner circumferential edge of each of the blades 4 and the corresponding blade 4 is defined as the entrance angle α. That is, the blades 4 of the impeller 3 are backward inclined blades, so that the fan is a kind of a turbofan.

Figure 4:
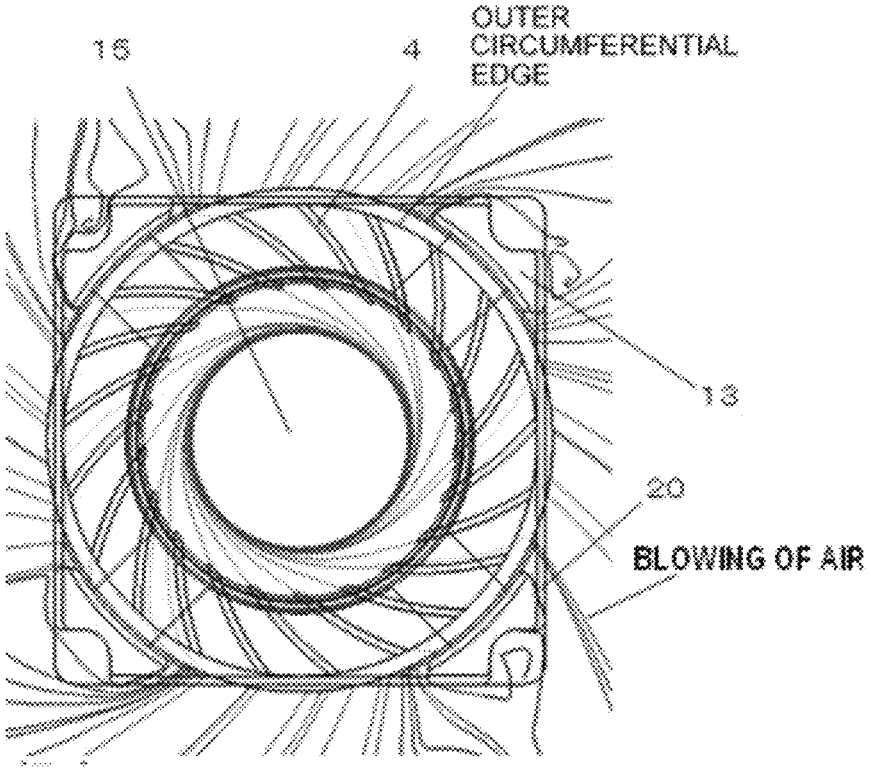
FIG. 4 is a view illustrating a simulation result of an air flow in the centrifugal fan according to an illustrative embodiment of the present invention.
Figure 5:
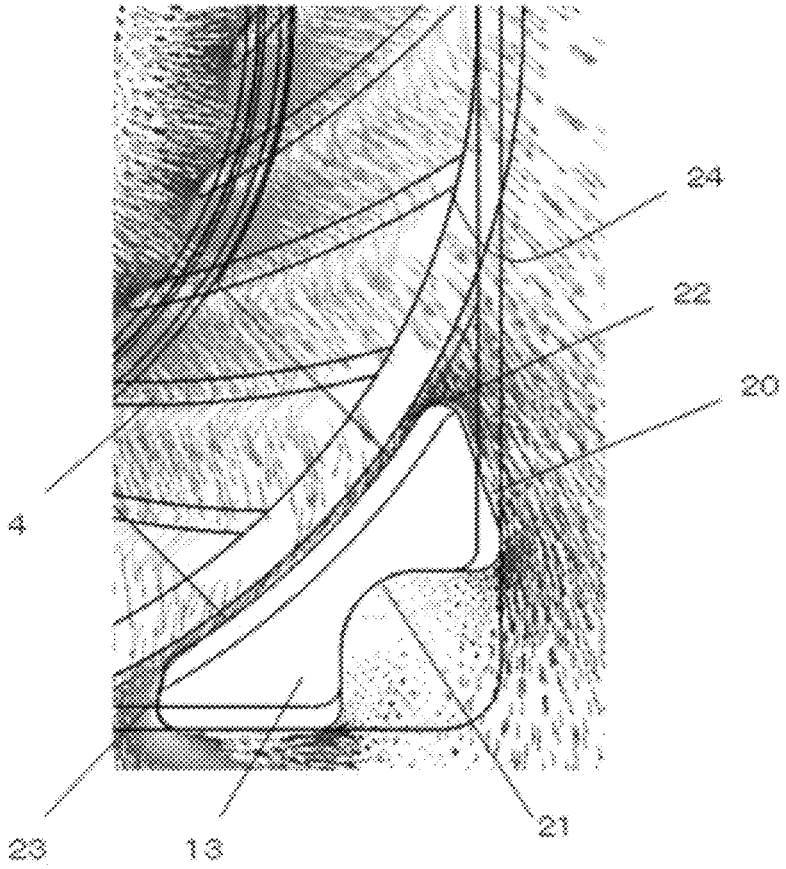
FIG. 5 is a detailed view illustrating a vicinity of a supporting strut.
Figure 7:
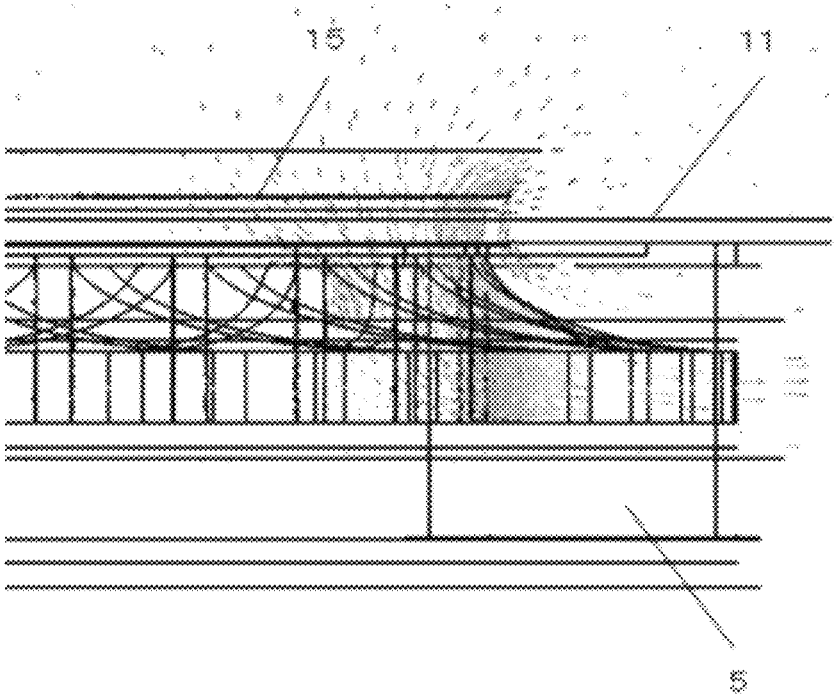
FIG. 7 is a cross-sectional view illustrating a portion of a cross section of the centrifugal fan shown in FIG. 4.

FIG. 4 is a view illustrating a simulation result of an air flow in the centrifugal fan according to an illustrative embodiment of the present invention, FIG. 5 is a detailed view illustrating the vicinity of a supporting strut, and FIG. 7 is a cross-sectional view illustrating a portion of a cross section of the centrifugal fan shown in FIG. 4.

Figure 8:
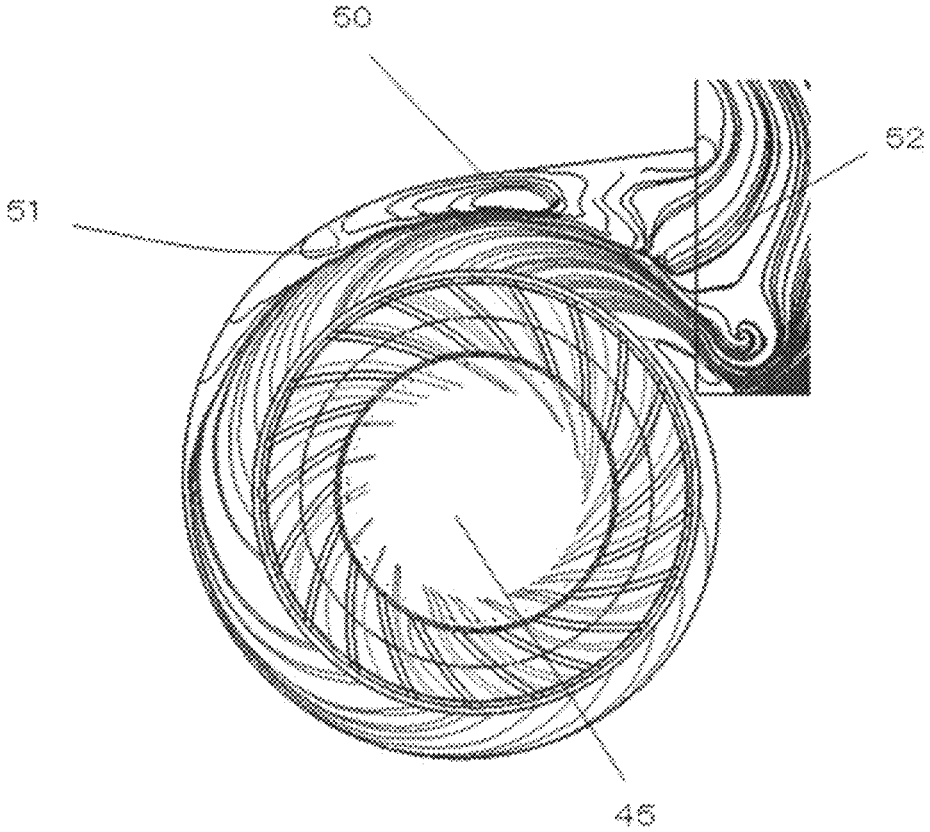
FIG. 8 is a view illustrating a simulation result of an air flow in a prior-art centrifugal fan.
Figure 9:
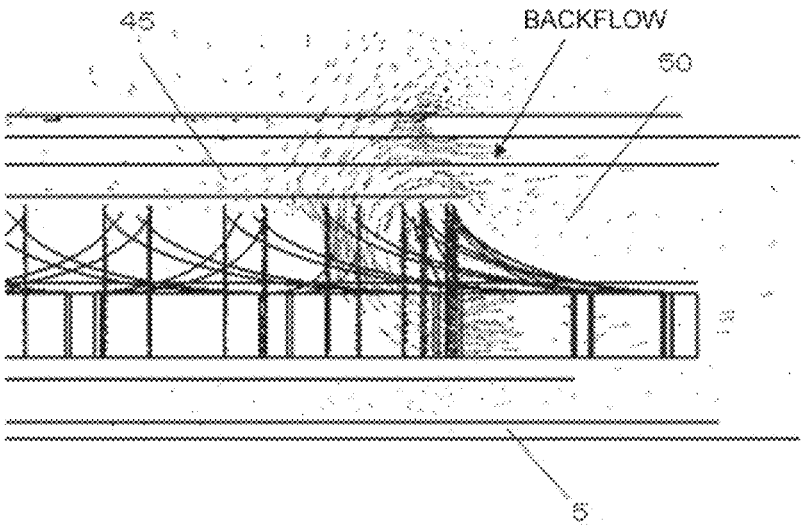
FIG. 9 is a cross-sectional view illustrating a portion of a cross section of the prior-art centrifugal fan shown in FIG. 8.

FIGS. 8 and 9 are views illustrating simulation results of an air flow in a related-art centrifugal fan having a scroll casing. Both the centrifugal fan according to the illustrative embodiment of the present invention and the related-art centrifugal fan having the scroll casing use the impeller 3 having a configuration shown in FIG. 3. The simulation result of the air flow shown in FIGS. 8 and 9 shows an air flow at the static pressure Pa=0.

As shown in FIG. 4, in the centrifugal fan 1 according to the illustrative embodiment of the present invention, air suctioned from the suction opening 15 according to the rotation of the impeller 3 passes between the blades 4 of the impeller 3 and is discharged outward from the outer circumferential edge of the impeller 3. At this time, since the four lateral sides of the casing 10 have only the supporting struts 13 to form the openings, the air discharged from the impeller 3 is discharged to the outside of the casing from the openings of the four lateral sides of the casing 10.

FIG. 5 is a detailed view illustrating the vicinity of a supporting strut, and shows a state of an air flow in the vicinity of the supporting strut 13. As shown in FIG. 5, the air passing between the blades 4 of the impeller 3 is discharged outward from the outer circumferential edge of the impeller 3. The lateral faces 20 of the supporting struts 13 are formed to be in parallel with the blowing direction of the air discharged outward from the outer circumferential edge of the impeller 3. Therefore, in the vicinities of the supporting struts 13, since the air discharged outward from the outer circumferential edge of the impeller 3 smoothly flows along the lateral faces 20 of the supporting struts 13, disturbance does not occur in the air flow in the vicinities of the supporting struts 13. As a result, noise due to disturbance of discharged air is significantly suppressed, so that a noise reduction can be achieved.

Figure 6:
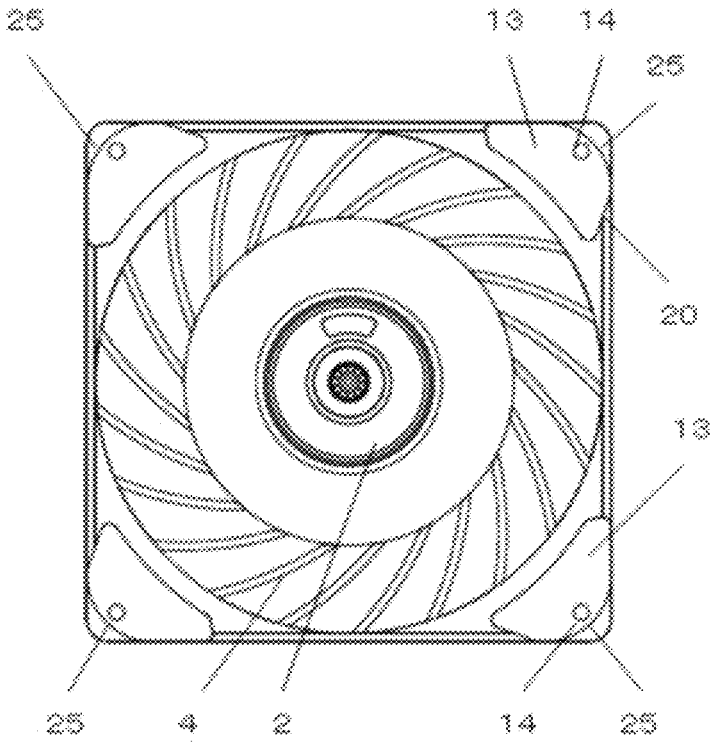
FIG. 6 is a plan view illustrating a centrifugal fan according to another illustrative embodiment of the present invention, wherein a lower plate of a casing is removed.

As shown in FIG. 2, the supporting struts 13 have recesses 21 formed on the outer circumference sides thereof to receive the connecting members (such as bolts or rivets) for connecting the upper plate 11 and the lower plate 12 together. However, the present invention is not limited thereto. For example, as shown in FIG. 6, the supporting struts 13 may have arc-shaped side walls 25 formed on the outer circumference sides thereof instead of the recesses 21. The side walls 25 are formed with through-holes 14 for inserting the connecting members into the supporting struts 13. If the arc-shaped side walls 25 are formed, it is possible to prevent the air flow from being caught in the recesses 21, and thus it is possible to further suppress disturbance of the air at the outer circumferential surfaces of the supporting struts 13.

A gap is uniformly formed between the outer circumferential edge of the impeller 3 and the surface of each supporting strut 13 facing the outer circumferential edge of the impeller 3. The gap may be formed to gradually increase from a side of the lateral face 20 and toward an opposite side of the supporting struts 13 (from a corner portion 22 toward a corner portion 23 shown in FIG. 5). In this case, it is possible to suppress concentrating of the air flow in the vicinity of the corner portion 23, and it is possible to further reduce noise.

FIG. 7 is a cross-sectional view illustrating a portion of a cross section of the centrifugal fan shown in FIG. 4. As shown in FIG. 7, the air suctioned according to the rotation of the impeller 3 passes between the blades 4 of the impeller 3, efficiently, without disturbance occurring in the air in the vicinity of the suction opening 15.

As shown in FIG. 8, in the related-art centrifugal fan having the scroll casing, air suctioned from a suction opening 45 according to the rotation of the impeller 3 passes between the blades 4 of the impeller 3 and is discharged outward from the outer circumferential edge of the impeller 3. The air discharged from the impeller 3 is guided to an inner wall 51 of the scroll casing 50 and is discharged outward from a discharge opening 52 of the casing 50. However, as shown in FIG. 8, a portion of the air discharged outward from the outer circumferential edge of the impeller 3 collides with the inner wall 51 of the scroll casing 50 such that disturbance occurs in the air, and the disturbed air causes disturbance of air in the vicinity of the discharge opening 52 of the casing 50. As a result, noise is generated due to the disturbance of the air in the vicinity of the discharge opening 52.

FIG. 9 is a cross-sectional view illustrating a portion of a cross section of the related-art centrifugal fan shown in FIG. 8. As shown in FIG. 9, the air suctioned from the suction opening 45 according to the rotation of the impeller 3 is disturbed in the vicinity of the suction opening 45. The disturbance of the air occurs since a portion of the air flows backwards after the air suctioned from the suction opening 45 passes between the blades 4 of the impeller 3. As described above, a portion of the air suctioned from the suction opening 45 flows backward from between the annular shroud 6 and the blades 4 to the suction opening 45, and this backward flow results in a reduction in air flow of the air discharged outward from the outer circumferential edge of the impeller 3.

Noise from the centrifugal fan according to the illustrative embodiment of the present invention shown in FIG. 1 and the related-art centrifugal fan having the scroll casing shown in FIG. 8 was measured on the basis of JIS B 8340. As a result, the related-art centrifugal fan having the scroll casing was 61 dB(A), whereas the centrifugal fan according to the illustrative embodiment of the present invention was 54 dB(A). That is, it is appreciated that the centrifugal fan according to the illustrative embodiment of the present invention can significantly suppress noise, as compared to the related-art centrifugal fan having the scroll casing.

Figure 10:
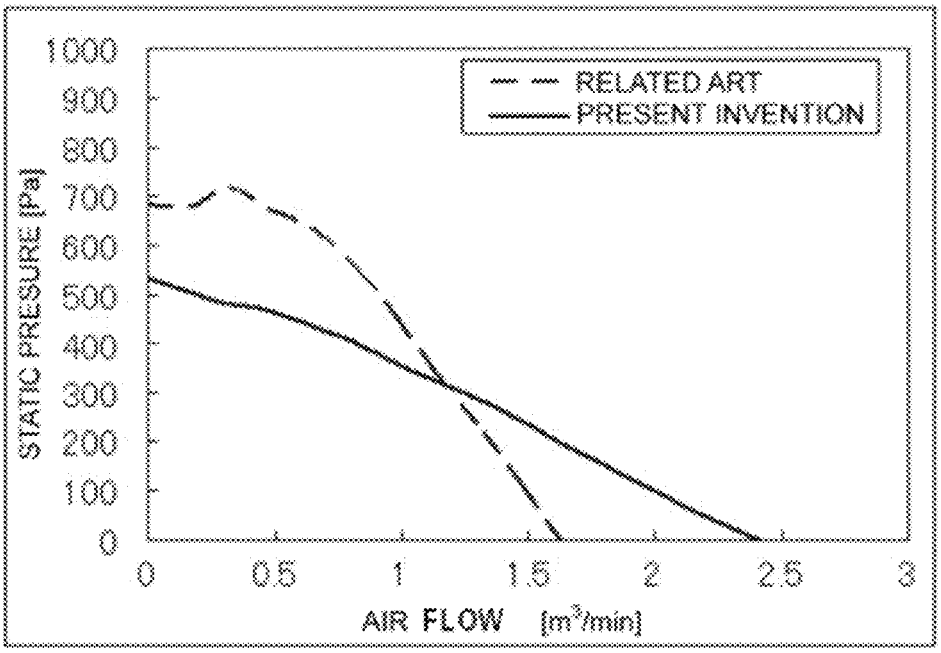
FIG. 10 is a view illustrating a static pressure-air flow characteristic in the centrifugal fan according to an illustrative embodiment of the present invention and a prior-art centrifugal fan having a scroll casing.
Figure 11:
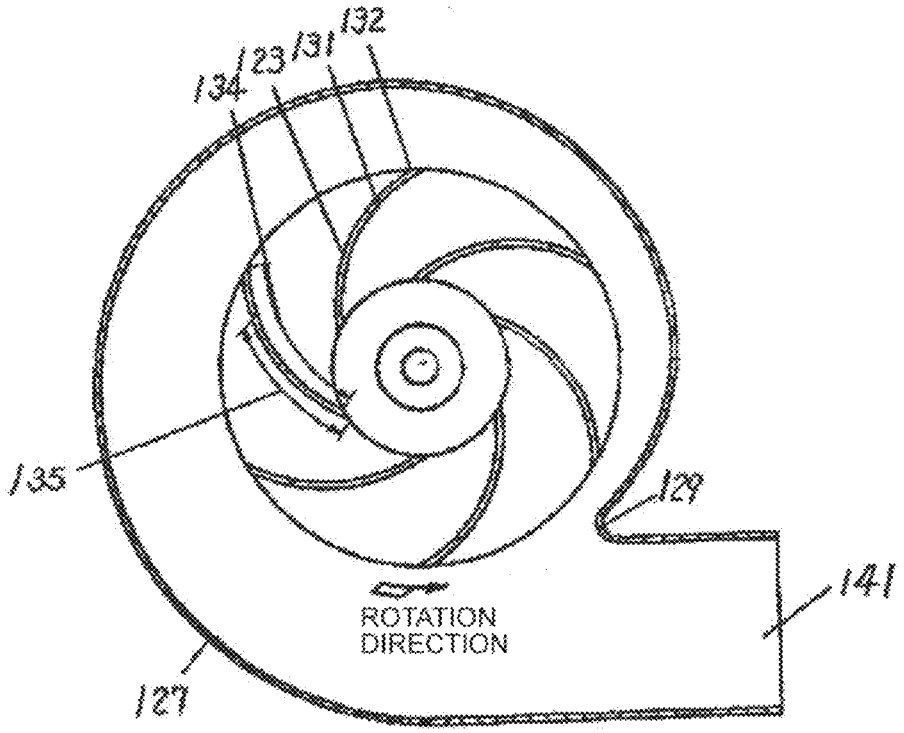
FIG. 11 is a plan view illustrating a prior-art centrifugal fan.
Figure 12:
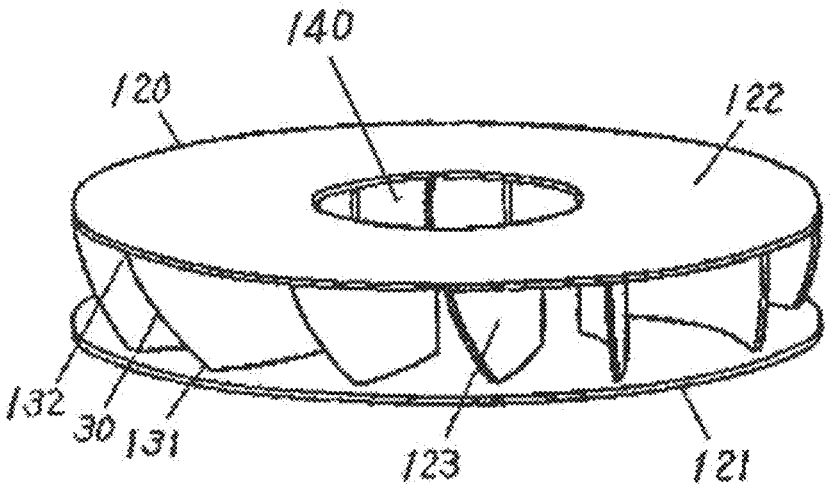
FIG. 12 is a perspective view illustrating an impeller of the centrifugal fan shown in FIG.

FIG. 10 is a view illustrating features regarding a relation between a static pressure and an air flow (P-Q characteristics) in the centrifugal fan according to the illustrative embodiment of the present invention shown in FIG. 1 and the related-art centrifugal fan having the scroll casing shown in FIG. 8. Both of the impellers 3 have the configuration shown in FIG. 3. As shown in FIG. 10, the centrifugal fan according to the illustrative embodiment of the present invention has a lower maximum static pressure and a greater maximum air flow, as compared to the related-art centrifugal fan having the scroll casing. The reason why the maximum static pressure is lower is that there is not provided a scroll casing for increasing the pressure of air discharged from the impeller 3.

Further, as shown in FIG. 9, in the related-art centrifugal fan having the scroll casing 50, a phenomenon that the air discharged from the impeller 3 collides with the inner wall 51 of the scroll casing 50 and a portion of the air flows back in the impeller 3 occurs. However, in the centrifugal fan according to the illustrative embodiment of the present invention, since the air discharged from the impeller 3 is discharged from the openings formed at the lateral sides of the casing 10, the phenomenon that the air flows back in the impeller 3 and flows into the suction opening 15 does not occur such that the air flow is not reduced. Therefore, it is possible to increase the maximum air flow. The shapes of the impellers 3 of both fans are the same, such that the outside diameter is 120 mm, and the casing of the centrifugal fan according to the illustrative embodiment of the present invention is a square shape of which each side is 120 mm. Meanwhile, the outside diameter of the related-art scroll casing is about 190 mm. Therefore, in a case where the casing of the centrifugal fan according to the illustrative embodiment of the present invention is formed in a square shape having a side of 190 mm like the outside diameter of the related-art scroll casing, the P-Q characteristics shown in FIG. 10 shows a tendency to move in parallel upward such that the maximum static pressure becomes equal to that of the related-art scroll casing. Therefore, it is possible to significantly increase the maximum static pressure, and to significantly improve the P-Q characteristics, as compared to the related-art scroll casing. Therefore, in the centrifugal fan according to the illustrative embodiment of the present invention, it is possible to provide a fan having high air-flow characteristics.

The usage of the centrifugal fan according to the illustrative embodiment of the present invention are not limited particularly, but can be used widely. In a case where the centrifugal fan is used for cooling, ventilation, and air conditioning of home appliances, OA devices, and industrial equipment, an air blower for a vehicle, and the like, it is possible to provide a centrifugal fan which has a high air-flow feature while suppressing noise, as compared to the related-art centrifugal fan having the scroll casing.

In the present illustrative embodiment, the casing 10 is formed in a square shape. However, the present invention is not limited thereto. The casing may have any arbitrary shape such as a polygon shape, a circle shape, and an asymmetric shape. The shape of the supporting struts is not limited by the present illustrative embodiment, but is appropriately set on the basis of the simulation result of the air flow and may be a cylindrical shape having the size enough to allow the connecting members to be inserted thereto. If the supporting struts 13 have a cylindrical shape having the size enough to allow the connecting members to be inserted thereto, air discharged from the impeller 3 can be discharged outward from the lateral sides of the casing 10 with rarely receiving resistance. Therefore, it is possible to provide a centrifugal fan capable of further reducing noise.

The shape of the supporting struts may be a blade shape having a size enough to allow the connecting members to be inserted thereto. If the blade shape is appropriately set, the air discharged from the impeller 3 can be discharged outward from the lateral sides of the casing 10 with rarely meeting with resistance. Therefore, it is possible to provide a centrifugal fan capable of increasing the static pressure of the air discharged from the impeller 3.

The blades of the impeller in the present illustrative embodiment are backward inclined blades and have a curved blade shape inclined backward in the rotation direction such that the centrifugal fan according to the present illustrative embodiment functions as a turbofan. However, in that it is possible to suppress noise due to the scroll casing, the blades of the impeller may have a curved blade shape inclined forward such that the centrifugal fan serves as a sirocco fan.

What is claimed is:

1. A centrifugal fan configured such that an impeller having a plurality of blades along a circumferential direction and disposed between a disk-shaped main plate and an annular shroud is accommodated in a casing, and that air suctioned from a suction opening is discharged outward in a radial direction of the impeller by a centrifugal force due to a rotation of the impeller, and thereby discharging the air from the casing, wherein the casing includes an upper plate formed with the suction opening, a lower plate, and a plurality of supporting struts interposed between the upper plate and the lower plate, and lateral sides formed between the supporting struts, wherein each of the lateral sides of the casing have only the supporting struts to form discharge openings, wherein the air suctioned from the suction opening of the upper plate is discharged outward in the radial direction of the impeller through spaces between the plurality of blades, and the air discharged outward in the radial direction of the impeller is discharged from the discharge openings, wherein at least one of the supporting struts comprises:

a first side wall that is positioned at an upstream side with respect to a rotational direction of the impeller;

a second side wall that is positioned at a downstream side with respect to the rotational direction of the impeller; and a third side wall that is arranged to face the impeller, and wherein the first side wall is arranged to be inclined inward from one of the lateral sides of the casing.

2. The centrifugal fan according to claim 1, wherein each of the plurality of supporting struts has a lateral face, and a blowing direction of the air from the impeller becomes parallel with the lateral face of the supporting strut in a vicinity of the supporting strut.

3. The centrifugal fan according to claim 1, wherein each of the plurality of supporting struts has a cylindrical shape and allows a connecting member for connecting the upper plate and the lower plate to pass through the supporting strut.

4. The centrifugal fan according to claim 1, wherein the plurality of blades of the impeller are forward inclined blades in a rotation direction.

5. The centrifugal fan according to claim 1, wherein the disk-shaped main plate has a cup-shaped boss portion at a center thereof.

6. The centrifugal fan according to claim 1, wherein the casing has four lateral sides.

7. The centrifugal fan according to claim 1, wherein a gap formed between an outer circumferential edge of the impeller and a surface of each of the supporting struts is gradually increased in a rotation direction of the impeller.

8. A centrifugal fan configured such that an impeller having a plurality of blades along a circumferential direction and disposed between a disk-shaped main plate and an annular shroud is accommodated in a casing, and air is suctioned from a suction opening and discharged outward in a radial direction of the impeller by a centrifugal force due to a rotation of the impeller, thereby discharging the air from the casing, wherein the casing includes an upper plate formed with the suction opening, a lower plate, and a plurality of supporting struts interposed between the upper plate and the lower plate, and lateral sides formed between the supporting struts, wherein each of the lateral sides of the casing have only the supporting struts to form discharge openings, wherein at least one of the supporting struts comprises:

a first side wall that is positioned at upstream side with respect to a rotational direction of the impeller;

a second side wall that is positioned at downstream side with respect to the rotational direction of the impeller; and a third side wall that is arranged to face the impeller, and wherein the first side wall is arranged to be inclined inward from one of the lateral sides of the casing.

wherein the air suctioned from the suction opening of the upper plate is discharged outward in the radial direction of the impeller through spaces between the plurality of blades, and the air discharged outward in the radial direction of the impeller is discharged from the discharge openings, wherein the plurality of blades of the impeller are backward inclined blades in a rotation direction, and wherein each of the supporting struts has a surface which matches a line passing through a center point of a radius of curvature of an arc surface of each of the blades and a leading edge of an outer circumferential edge of the corresponding blade.

* * * * *